US005727366A

United States Patent [19]

Manly, Jr.

[11] Patent Number: 5,727,366

[45] Date of Patent: Mar. 17, 1998

[54] REGISTRATION CONTROL

[75] Inventor: John B. Manly, Jr., Moore, S.C.

[73] Assignee: Milliken Research Corporation, Spartanburg, S.C.

[21] Appl. No.: 835,686

[22] Filed: Apr. 10, 1997

[51] Int. Cl.[6] ..... B65B 9/20; B65B 41/18

[52] U.S. Cl. ..... 53/451; 53/51

[58] Field of Search ..... 53/551, 552, 51, 53/451, 450, 550, 389.4

[56] References Cited

U.S. PATENT DOCUMENTS

| | | | |
|---|---|---|---|
| 3,546,835 | 12/1970 | Mobley | 53/51 |
| 3,908,331 | 9/1975 | Donnet | 53/3 |
| 4,023,327 | 5/1977 | Simmons | 53/51 |
| 4,067,170 | 1/1978 | Yates, Jr. | 53/51 X |
| 4,128,985 | 12/1978 | Simmons | 53/51 |
| 4,288,965 | 9/1981 | James | 53/551 X |
| 4,316,566 | 2/1982 | Arleth et al. | 53/51 X |
| 4,391,079 | 7/1983 | Cherney | 53/396 |
| 4,552,608 | 11/1985 | Hoffmann et al. | 53/51 X |
| 4,680,205 | 7/1987 | Lerner et al. | 428/29 |
| 4,722,168 | 2/1988 | Heaney | 53/450 |
| 4,727,707 | 3/1988 | Hadden | 53/51 X |
| 4,744,202 | 5/1988 | Wylie | 53/51 X |
| 4,754,593 | 7/1988 | Ishihara et al. | 53/51 |
| 4,807,420 | 2/1989 | Barker | 53/51 |
| 4,860,522 | 8/1989 | Cherney | 53/451 |
| 4,868,759 | 9/1989 | Ross et al. | 364/468 |
| 5,067,307 | 11/1991 | Francioni et al. | 53/450 |
| 5,315,807 | 5/1994 | Restle et al. | 53/51 |

*Primary Examiner*—Horace M. Culver
*Attorney, Agent, or Firm*—Terry T. Moyer; Earle R. Marden

[57] ABSTRACT

Registration system for a continuously operating machine which produces a filled package with an upper and lower seal which automatically adjusts position and the speed of the packaging material being supplied and also adjusts the speed after a preselected number of position adjustments in either direction.

5 Claims, 4 Drawing Sheets

FIG. —4—

REGISTRATION CONTROL

This invention relates to an apparatus and method for controlling the registration of preprinted web package stock in a packaging machine. In a preferred embodiment, this invention relates to an apparatus and method for modifying the rate at which preprinted stock is supplied to a machine designed to produce tetrahedron-shaped packages from a flat web, in order to maintain the relative position on the package of the printed matter appearing on the preprinted package stock as the stock is formed into individual packages.

Machines which are designed to produce cushion shaped, parallelepipedic, or tetrahedral packages from a continuous roll or flat web of packaging material are well known in the packaging industry. Commonly, such machines are of the "form-fill-seal" variety, in which a continuous flat web of suitable packaging material, e.g., wax or plastic-coated paper which has been preprinted with a label, is formed into a vertically oriented tube-like structure. This is accomplished by passing the web through one or more ring-like guides and forming a vertical seam by adhesively joining the longitudinal edges of the web. This tube is then filled with the desired product. By compressing opposing sides of the tube in the presence of an adhesive or, more commonly, heat, the tube may be transversely sealed as the tube moves through the machine, thereby forming individual packages. The separate, connected packages may then be separated from one another by cutting the tube in the region of the transverse seams.

It is desirable to control to a very close degree the longitudinal position of the web material so that the information printed on the web material will be in substantially the same place on each package in order to provide appealing and consistent packages. If the position of the web material is not controlled, it may be necessary to have two repeats of the same printed matter for each package length of web material, which would result in smaller printing on each package and variations in the relative positioning of the printed information. It is also desirable to maintain consistent placement of the labels on individual packages in order to maintain the appearance of high standards of product uniformity and quality control. In the trade, such control of the position of the printed information on the package is referred to as "registered print."

This invention provides an apparatus and method suitable for maintaining registration of the print, i.e., maintain the relative position of the printed matter on the package, on a machine producing tetrahedron packages which uses a continuous and preferably uniform web material advancing mechanism, and which can be used to produce a plurality of filled tetrahedron packages on which the printing on the outside surface of each package is substantially in the same position on each such package, by controlling the position of the web material during the package formation process.

Details and advantages of this invention will become readily apparent from the following discussion, when read in conjunction with the accompanying Figures, in which FIG. 1 is a schematic representation of a form-fill-seal packaging machine designed to make tetrahedral-shaped containers filled with product from a continuous web of suitable packaging material, including control device embodying the instant invention;

It is understood that the disclosed invention can be used on any type of packaging machine in which the package stock is supplied continuously while the containers are being formed and filled.

Figure 1:
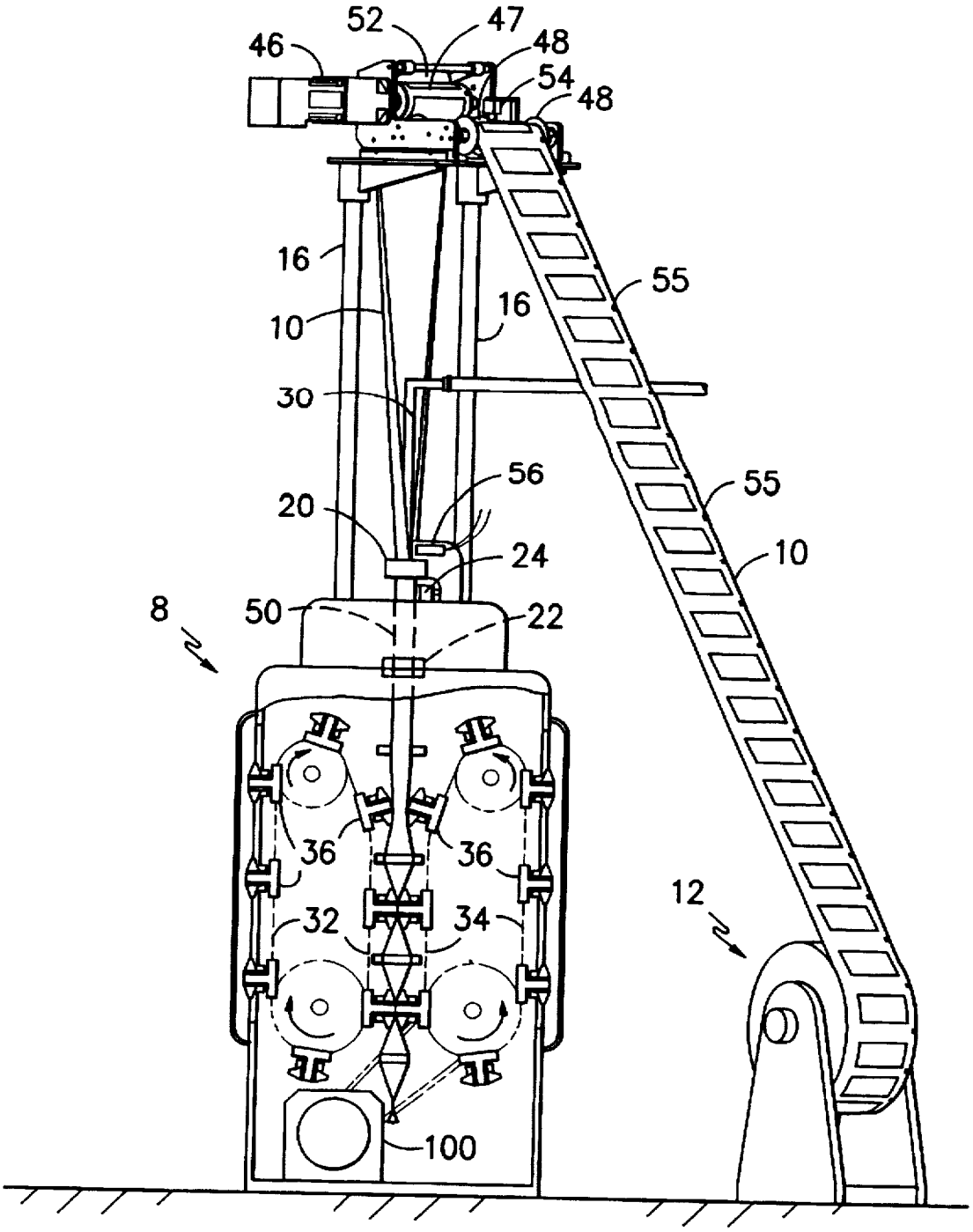

In the preferred embodiment of the instant invention shown in FIG. 1, a typical tetrahedron forming machine 8 is shown which forms tetrahedron-shaped filled containers from a roll of preprinted flat package stock, e.g., a polyethylene coated paper. The paper 10 is supported on a suitable support 12 and is delivered upwardly over a set of guide rolls associated, which rolls are supported by frame members 16 secured to the machine. The paper 10 is delivered downwardly through an oval collar 20 which longitudinally curls the paper 10 by bending the longitudinal edges of the sheet material toward one another. From the collar 20 the sheet material passes through a circular forming ring 22 where the overlap of the longitudinal edges is completed, and the package stock is in closed cylindrical (tube) form. An elongate heater 24 seals together the overlapped longitudinal edges with the assistance of a set of opposed rollers, not shown, between which the heated longitudinal edges are pressed together.

Figure 2:
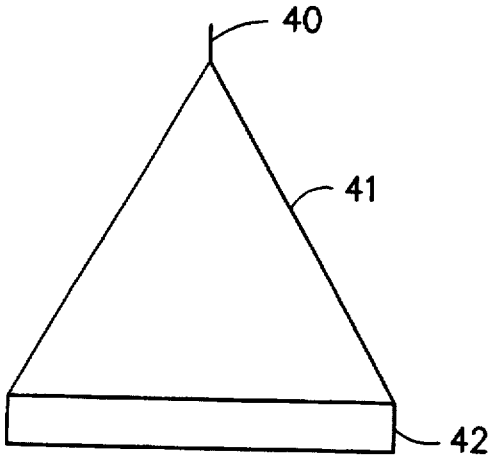
FIG. 2 is a schematic representation of a representative tetrahedron package formed by the machine of FIG. 1, which illustrates the relationship between package diameter and package length.

A fill pipe 30 is positioned to extend within the tube 50 of package stock, and extends to a point above the region where the transverse seals 40, 42 (FIG. 2) are formed to form the tetrahedron 41. To form the first and second transverse seals, two sets of endless chains carrying opposed heated sealing jaws 36 at fixed locations along the chains are continuously and uniformly rotated by driven sprockets. One set of endless chains is represented by reference numerals 32 and 34 while a second set of chains (not shown) is located parallel to the axis of the tubular sheet material and perpendicular to the first set of chains 32 and 34, i.e., to the front and rear of the view depicted in FIG. 1. As shown, the heating jaws 36 on the first set of chains form a transverse seal and simultaneously advance, via a pulling action, the tubular sheet material downwardly through the machine. The heating jaws on each set of chains are spaced two package lengths from one another, so that the heating jaws 36 on the second set of chains, located between, and axially displaced from, the heating jaws 36 on the first set of chains, have room to form a second transverse seal which is one package length away from and transverse to the first seal. Due to the staggered or interleaved relative positioning of the jaws in the first and second sets of chains, the top-most seal will be made by jaws carried on the first set of chains, then by jaws carried on the second set of chains, in alternating fashion. It can be seen that the continuously moving heating jaws form the first transverse seal in a region already occupied by product while the product is being supplied from the fill pipe, form the second transverse seal also in a region occupied by product, and supply a continuous chain of packages to a cutting means, not shown, wherein the transverse seals are severed along their length to form individual packages.

Figure 3:
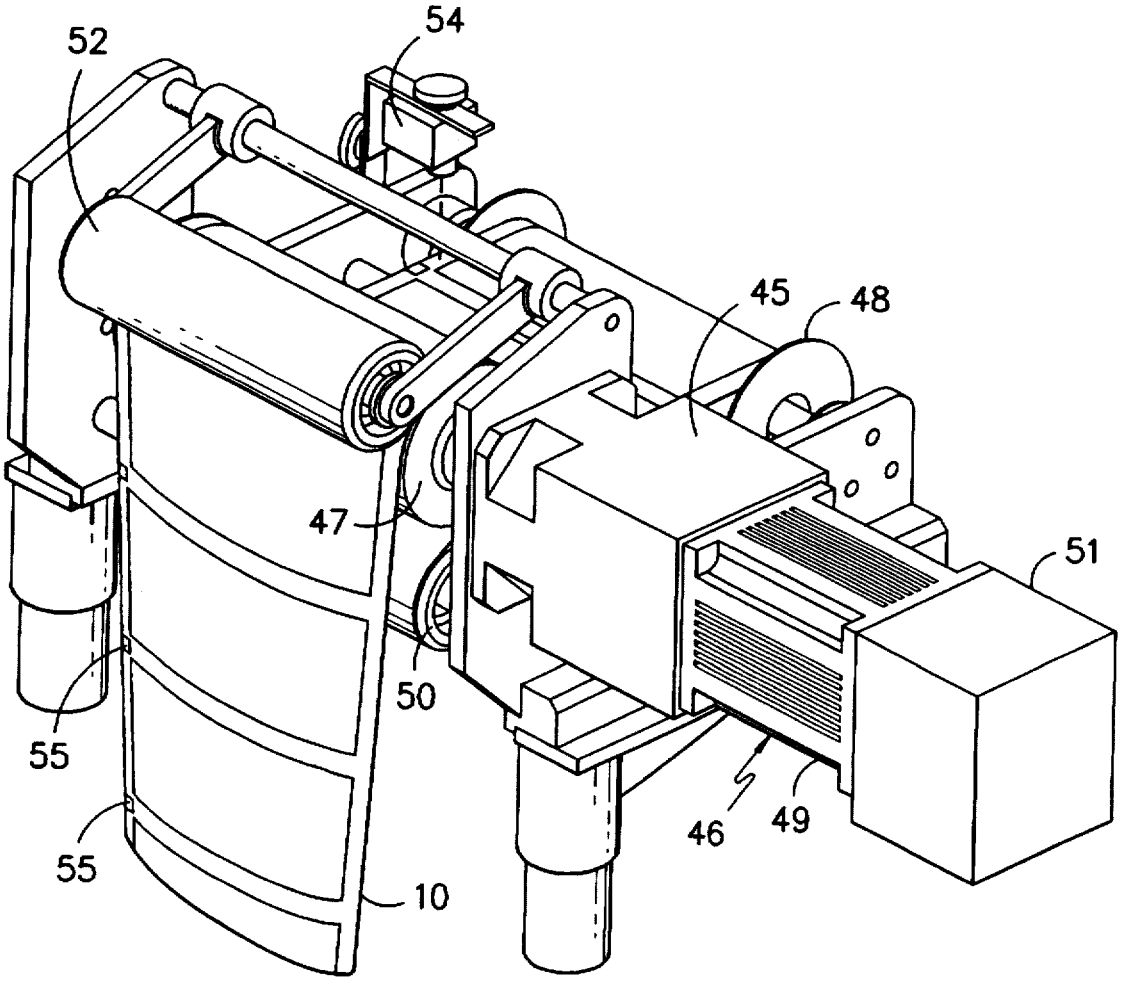
FIG. 3 is a perspective view of a registration device which provides control of the position of the printing on a completed tetrahedron package in accordance with the instant invention.
Figure 4:
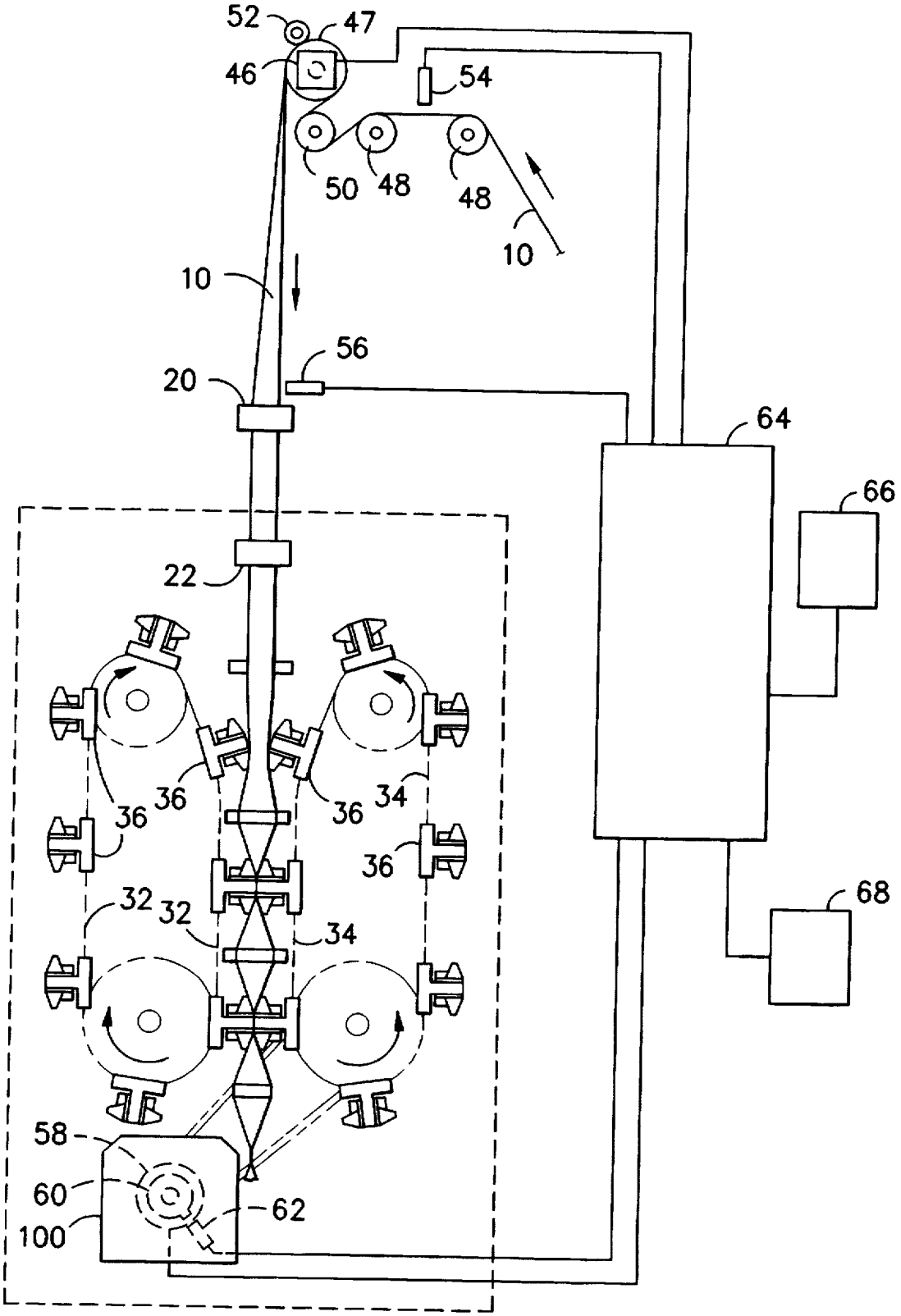
FIG. 4 is a schematic representation of a control system for the registration device shown in FIG. 3.

Looking at FIGS. 1 and 3 the path of the paper 10 from the support 12 to the lower forming ring 22 is controlled by the servomotor combination 46 including a gear-head 45, a servomotor 49 and a resolver 51. Basically the servomotor 49 drives the roll 47 to pull the paper 10 from the support 12 over the idler rolls 48 under the roll 50 and back over the roll 47 downward under the weighted roll 52 through the collar 20 to the lower forming ring 22. Looking at FIG. 4 an optical sensor 54 is located upstream of the roll 47 to read registration marks 55 printed on the paper 10 and another optical sensor 56 is downstream of the sensor 54 adjacent the upper forming ring 20 to detect a breakage in the paper 10. Suitably connected to the motor 100 driving the endless chains 32 and 34 is an encoder 58 having a cam 60 served by the proximity sensor 62. Sensors 54, 56, and 62 are each connected to a controller 64 connected to a control panel 66 and a computer 68 which is only used to program controller, not a part of normal operation. Sensor 62 sends an electrical pulse to the controller 64 for each rotation of the cam 60. This pulse is used to verify the synchronization between the endless chains 32 and 34, and the paper stock 10 when the registration system is first started. After starting, the pulses from sensor 62 are ignored by the controller 64.

OPERATION

As discussed previously, the packaging machine 8 operates continuously at the same speed so that the encoder 58 is driven at a constant speed to provide pulses to the controller 64. The speed of the paper 10 from the driven roll 47 has to be inspected to maintain the paper, being formed and filled, in registration. The logic flow chart of FIG. 5 shows the basic registration control system flow chart.

Figure 5:
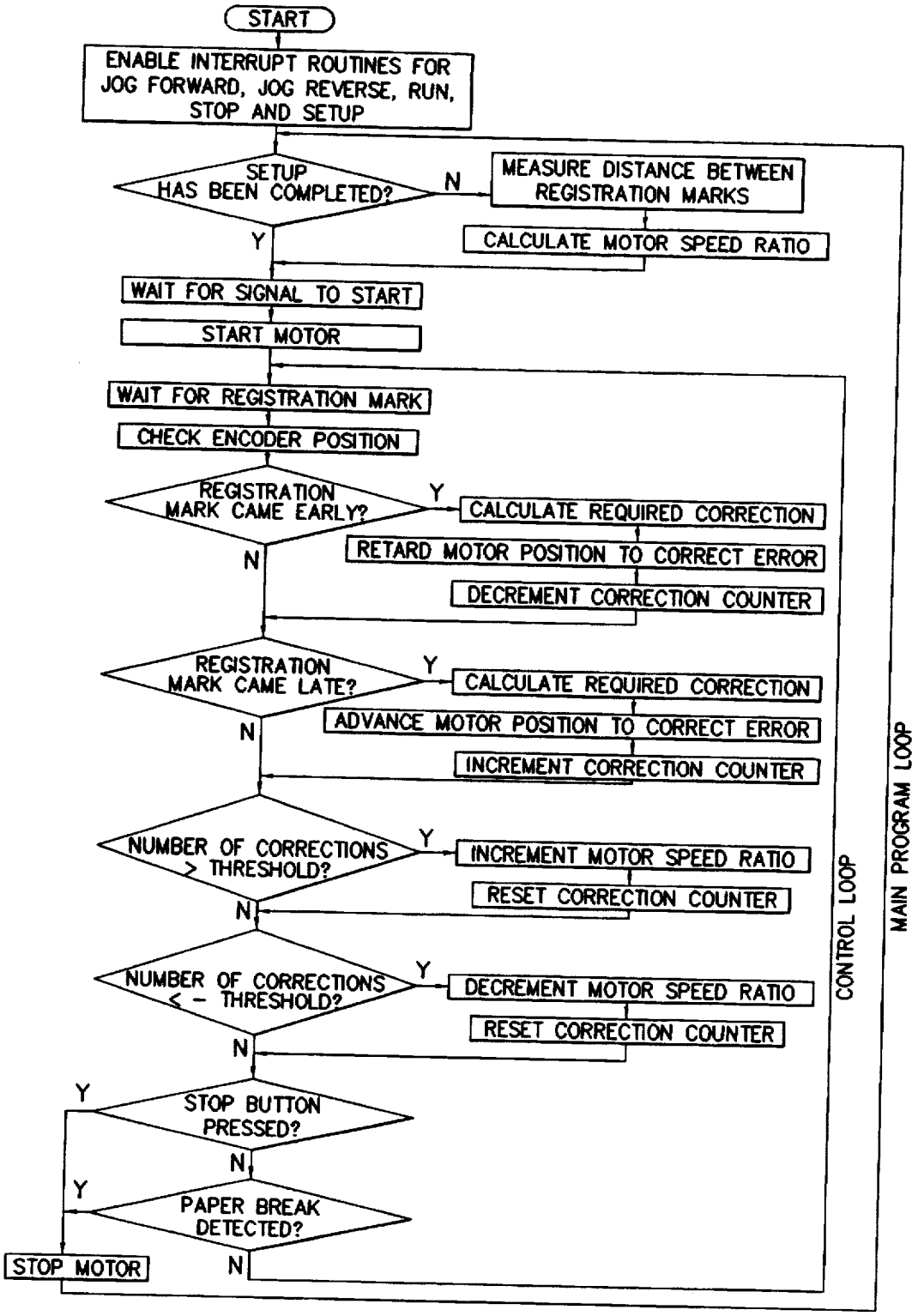
FIG. 5 is a logic flow chart for the new and improved registration control.

FIG. 5 illustrates the registration control system and is basically separate from the packaging machine drive system which rotates the heating jaw chains except that the encoder 58 is driven by the packaging machine drive system to send out constant pulses which are sent to the controller 64. The packaging machine is started prior to the threading of the paper 10 into the machine to be formed into package 41 and filled from the fill pipe 30.

Upon start-up of the packaging operation after the main packaging machine motor 100 has been started, the paper is inserted in the nip between the roll 47 and the roll 52 and jogged by the servomotor 46 past the sensors 54 and 56. The sensor 54 will sense the registration marks on the paper and provide a signal to the controller, which, will measure the distance between successive registration marks on the paper and calculate the theoretical ratio between the speed of the servomotor 49 and constantly driven encoder 58 to cause the servomotor to run at a certain preselected rate. Once this ratio has been set and the sensor 56 has determined that there is no break in the paper 10 being supplied to the forming ring 20, the machine is ready to continuously form and fill packages 41.

As mentioned previously, the packaging machine runs continuously and the sensors 54 and 56 continuously read the registration marks on the paper 10 being supplied. Each time a registration mark is detected by the upper optical sensor 54, the controller 64 uses the input from the encoder 58 to calculate how far the machine has advanced since the last registration mark was found. If the machine has moved farther than it should have, meaning the paper has not advanced enough, the paper is advanced the exact amount needed to correct the discrepancy. If the machine has not moved as far as it should have, meaning the paper has advanced too much, the paper is retarded the exact amount needed to correct the discrepancy.

Each time a correction is made, the direction of correction (advance or retard) is noted. If the number of successive corrections in either direction exceeds a certain value, the ratio between the encoder 58 and the servo-motor 46 is adjusted to compensate and adjust the speed of the paper 10 being supplied. This has the effect of reducing the number and magnitude of corrections made at each registration mark. For example, if the paper is advanced five times in a row, the paper is not moving fast enough, so the ratio between the encoder 58 and the servo-motor 46 is increased a small amount so the paper does not need to be advanced every time a registration mark passes.

When the operator wishes to stop the machine for any reason, he can simply stop the packaging machine. Since the speed of the servo-motor is governed by the speed of the packaging machine 8, it will decelerate to a stop in synchronization with the machine. When the machine is started again, the registration will continue without interruption.

If the operator wishes to stop registration without stopping the machine, he presses the "Stop" button on the control panel. This stops the servo-motor 46, breaking the paper between the servo-motor nip drive and the packaging machine.

In addition to providing registration, the controller 64 provides for detecting the breakage of the paper 10 between the nip roll 47 and the upper form ring 20 of the packaging machine. This is detected by the lower optical sensor 56. During normal operation, if the number of registration marks passing the lower optical sensor 56 does not correspond to the number of registration marks passing the upper optical sensor, paper breakage is assumed by the controller 64, the nip drive is stopped and the automatic registration is disabled.

It is obvious that a paper registration system for a continuously operating packaging machine has been described which maintains the machine in registration by scanning registration marks printed on the paper stock and in cooperation with a reading taken from the speed of the packaging machine provides an adjustment system which slows or increases the velocity of the paper being supplied and includes an automatic system to re-calculate the adjustment mechanism to prevent repeated advancement or retardation of the packaging material 10.

The above described embodiment is given for the purpose of illustration only and improvements and modifications may be made within the scope and it is therefore desired that the invention be limited only by the scope of the claims.

I claim:

1. A method for controlling the registration of preprinted package stock in a form-fill-seal packaging machine in which individual packages are formed in substantially continuous fashion, said package stock being drawn through said machine by the advancing action of moving sets of opposed jaws, said method comprising the steps of: supplying a quantity of package stock having registration medium placed thereon, detecting the position of successive registration medium on said stock and supplying said detection to a controller, detecting the speed of said machine and supplying the detection to said controller to form a ratio of speed to distance between registration marks and continuing to detect the registration medium on the stock and adjusting the speed of the supply of paper to said machine by comparison of the position of the detected medium to the ratio to either speed up or slow down the supply of paper stock.

2. The method of claim 1 wherein the ratio is adjusted when the number of supply adjustments in either direction exceeds a preselected number.

3. A method for controlling the registration of preprinted package stock in a form-fill-seal packaging machine in which individual packages are formed in substantially continuous fashion from a tube-like structure, said package stock being drawn through said machine by the advancing action of moving sets of opposed jaws, said jaws forming said packages by compressing opposing sides of said tube-like structure, thereby forming a transverse seal, said method comprising the steps of: supplying a quantity of package stock having registration medium placed thereon, detecting the position of successive registration medium on said stock and supplying said detection to a controller, detecting the speed of said machine and supplying the detection to said controller to form a ratio of speed to distance between registration marks and continuing to detect the registration medium on the stock and adjusting the speed of the supply of paper to said machine by comparison of the position of the detected medium to the ratio to either speed up or slow down the supply of paper stock.

4. The method of claim 3 wherein the ratio is adjusted when the number of supply adjustments in either direction exceeds a preselected number.

5. The method of claim 4 above wherein the package formed above is tetrahedral shaped.

* * * * *